US007237649B2

(12) United States Patent
Harmston

(10) Patent No.: US 7,237,649 B2
(45) Date of Patent: Jul. 3, 2007

(54) TREE LADDER

(76) Inventor: Terry Harmston, 9860 Cloverleaf Pkwy., Blaine, MN (US) 55434

( * ) Notice: Subject to any disclaimer, the term of this patent is extended or adjusted under 35 U.S.C. 154(b) by 860 days.

(21) Appl. No.: 10/077,735

(22) Filed: Feb. 19, 2002

(65) Prior Publication Data

US 2002/0096396 A1 Jul. 25, 2002

Related U.S. Application Data

(60) Provisional application No. 60/259,683, filed on Jan. 5, 2001.

(51) Int. Cl.
*E06C 9/00* (2006.01)

(52) U.S. Cl. ..... 182/93

(58) Field of Classification Search ..... 182/93, 182/135, 136, 20, 116, 187, 188, 194; 108/152
See application file for complete search history.

(56) References Cited

U.S. PATENT DOCUMENTS 4,592,446 A * 6/1986 White ..... 182/93
4,991,690 A * 2/1991 Woller ..... 182/93
5,105,908 A * 4/1992 Freund ..... 182/20
5,368,127 A 11/1994 Phillips ..... 182/187
5,454,445 A 10/1995 Berryman ..... 182/116
5,590,738 A 1/1997 Hunt et al. ..... 182/116
5,655,623 A 8/1997 Skyba ..... 182/116
5,779,001 A 7/1998 Skyba ..... 182/107
5,791,436 A 8/1998 Talley, Sr. ..... 182/116
6,053,278 A 4/2000 Myers ..... 182/20
6,138,792 A * 10/2000 Morris ..... 182/93
6,516,918 B2 * 2/2003 Hess ..... 182/20

* cited by examiner

*Primary Examiner*—Hugh B. Thompson, II
(74) *Attorney, Agent, or Firm*—Steven E. Kahm; Nikolai & Mersereau, P.A.

(57) ABSTRACT

A ladder for climbing trees and other vertical elements having a pair of spaced stiles, a plurality of rungs between such stiles and stand off elements on the stiles or rungs for spacing the ladder from the object to be climbed which will maintain the ladder in generally parallel relation to the object. Adjustable straps secure the ladder to the object. The ladder is provided in joinable sections to permit the same to be erected against the object without scaling the ladder.

4 Claims, 2 Drawing Sheets

TREE LADDER

PROVISIONAL APPLICATION REFERENCE

The subject matter of this invention and application was disclosed through the filing of a Provisional Application entitled Tree Ladder, Filed Jan. 5, 2001, Ser. No. 60/259,683.

SPONSORSHIP

This invention was not made under the sponsorship of any third party including any Federal or Independent Sponsor and was made through the sole efforts of the named inventor.

RELATED APPLICATIONS

Other than the above identified Provisional Application, applicant has not filed any previous applications pertinent to this subject matter and is not aware of any applications by third parties that are pertinent to the invention disclosed herein.

FIELD OF THE INVENTION

This invention relates generally to ladders utilized in climbing or scaling trees or other upright elements and more specifically to a ladder for safely climbing the same including the method for securing the same to the tree or other upright element before he or she climbs the same.

SHORT SUMMARY OF THE INVENTION

A ladder including a pair of laterally spaced stiles or longitudinally extending members having a plurality of spaced rungs therebetween to accommodate a person scaling an upright article such as a tree, pole or the like. Stand off elements are provided, selectively, on the stiles or rungs to space the ladder from the scaled article and allow the user to place his or her foot comfortably on a rung. The stiles are arranged in predetermined lengths with longitudinal connectors between the lengths to provide an easily transported unit which is assembled on site for use. The standoffs will maintain the ladder in generally parallel relation to the article rather than to lean thereagainst. The ladder is maintained in such parallel position through adjustable straps which gird or connect to the tree or article to be scaled. The ladder is securable to the tree or article without the user leaving the ground.

BACKGROUND AND OBJECTS OF THE INVENTION

Ladders, which include what are known as stick ladders, have been used for climbing of trees, poles and the like for a long period of time. In using such a ladder, the ladder is commonly leaned against the article to be climbed, the ladder climbed, at least partially, for attachment of straps or the like to the tree or pole after which the climber proceeds upwardly to further attach the ladder to the tree or pole. Such a system provides only an unstable climbing situation until the ladder is firmly secured to the climbed article. Single length ladders, although sectioned ladders are available, and are not easily transported through the woods or over terrain which is encountered, for example, when hunting.

The primary difficulty with such tree ladders was the method of securing the same to the climbed article. The user had to climb to a certain height, on an unfastened and thus unstable unit, to begin securing the same to the climbed article and then proceed upwardly, again on an unsecured length, to attach additional ropes, straps or the like to the climbed article. There was no method for securing the unit without climbing a certain length of the same in what was an unstable, wobbly manner.

With applicant's ladder, a sectioned ladder is provided with quick connect features between sections, which will afford an easily carried unit while insuring that sufficient height will be available for various uses. With applicant's ladder, standoffs are provided to extend from either the rungs or stiles such that the ladder may be positioned in close, parallel proximity to the article, for example, a tree, that is being scaled. These standoffs are of sufficient length to allow the user to place his or her foot on a rung and have the toe extend past the rung to locate the foot well onto the rung.

The applicant also provides a structure which includes and allows for a method of attaching his ladder to a tree without climbing any portion thereof until the same is fully erected and secured. This is provided through a strapping method which affords strap attachment means such that a ladder section may be positioned against a tree, the section secured to the same, the section elevated to receive another section and sequentially elevated into place on the tree.

Similarly, the applicant's sections may be assembled at the tree or pole site, positioned against the article and secured to the same without leaving the ground.

When in desired position, the straps for securing the same are tightened and the ladder is maintained in tree or pole parallel position.

At least a pair of adjustable binding straps are provided which may be attached to the tree or which will, preferably, encircle and cross behind the tree at least one time and be reattached to another point on the ladder such that a positive connection to the article is obtained and maintained. These straps allow for length adjustment such that the ladder is positively secured to the scaled article during the stages of sequentially adding sections of ladder and the ladder is attached to the tree.

It is therefore an object of the applicant's invention to provide a ladder for scaling of various articles such as trees which eliminates that the ladder be leaned against the article.

It is a further object of the applicant's invention to provide a ladder that is provided in connectable sections for ease of personal transport and assembly at the point of use.

It is a further object of the applicant's invention to provide a ladder for use in scaling various articles which is provided with standoffs such that the same may be secured to the article in generally parallel relation thereto.

It is yet a further object of the applicant's invention to provide a ladder for use in scaling various articles which includes adjustable strap means for securing the same to the article and whereby the ladder may be sequentially or totally erected against the article and positively secured to the same without climbing the ladder to accomplish the attachment.

These and other objects and advantages of the applicant's invention will more fully appear from the accompanying drawings and description.

SHORT DESCRIPTION OF THE DRAWINGS

DESCRIPTION OF A PREFERRED EMBODIMENT OF THE INVENTION

In accordance with the accompanying drawings, a ladder embodying the concepts of the applicant's invention is generally designated 10 and is illustrated in operative or use position against a vertical element V that is to be scaled. The ladder 10 is secured to the vertical V through a strap system which may include a pair of straps 11*a*, 11*b* and an intermediate strap 11*c*. The straps 11*a*, 11*b* and 11*c* will include means 11*d*, 11*e*, 11*f* for tightening the same to secure the ladder 10, to the vertical V. In this position, the ladder 10 is substantially parallel to the vertical V, rather than leaning thereagainst.

Standoffs 16*a*, 16*b* are provided to space the ladder 10 from the vertical V for several purposes, one being that the user may place his or her foot comfortably and wholely upon the ladder rung.

In use, the ladder 10 would normally be used against a member that is in a relatively vertical position with respect to the ground.

The ladder 10 includes, in the form shown, a plurality of sections 12*a*, 12*b*, 12*c* each of which includes a pair of laterally spaced stiles or longitudinally extending members 13, 14 with rungs 15, extending therebetween and connected thereto. Rungs 15 are spaced at a comfortable distance to enable a person to climb the ladder 10.

Figure 1:
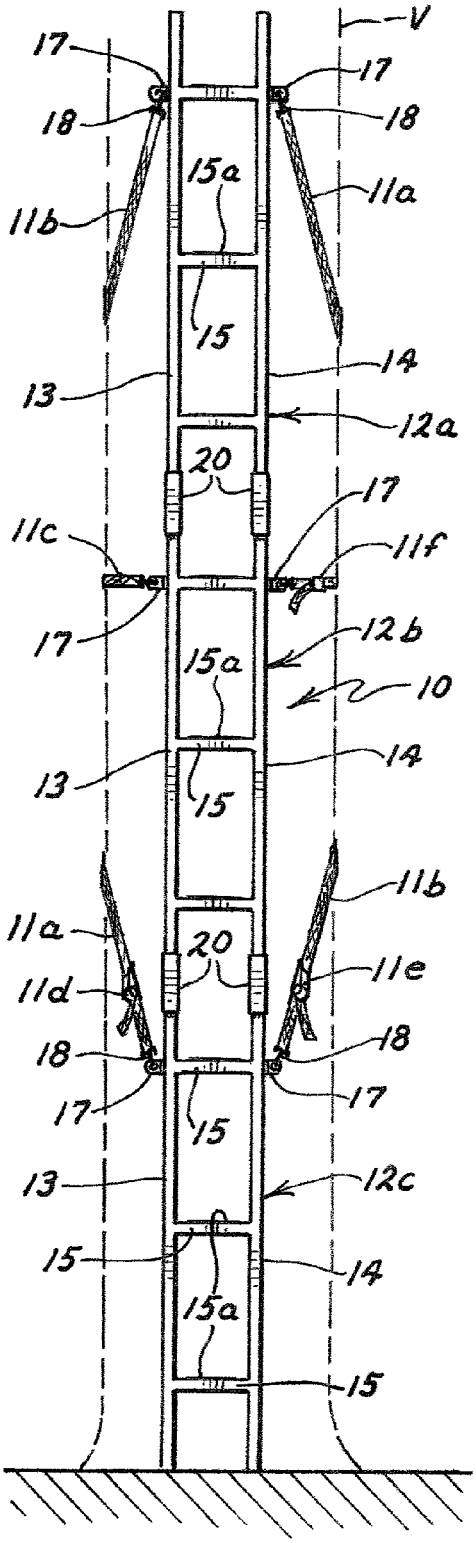
FIG. 1 is a front view of a ladder embodying the concepts of the applicant's invention with a vertical element to be scaled, illustrated by dotted lines.
Figure 2:
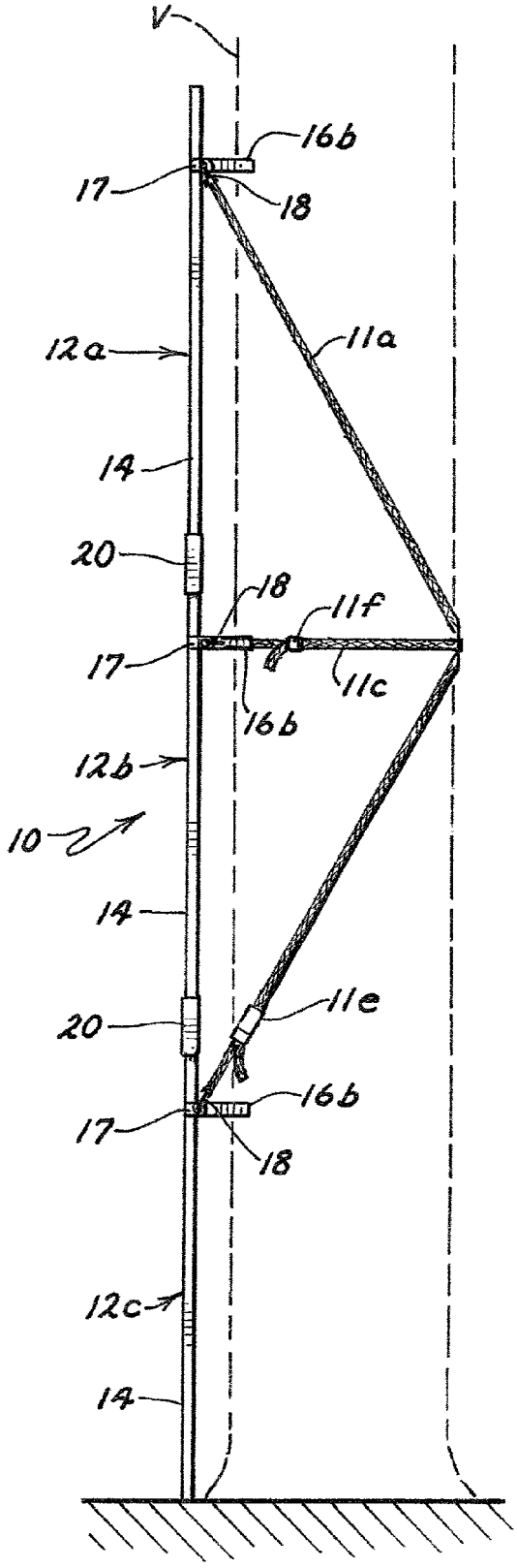
FIG. 2 is a side view taken from FIG. 1.
Figure 3:
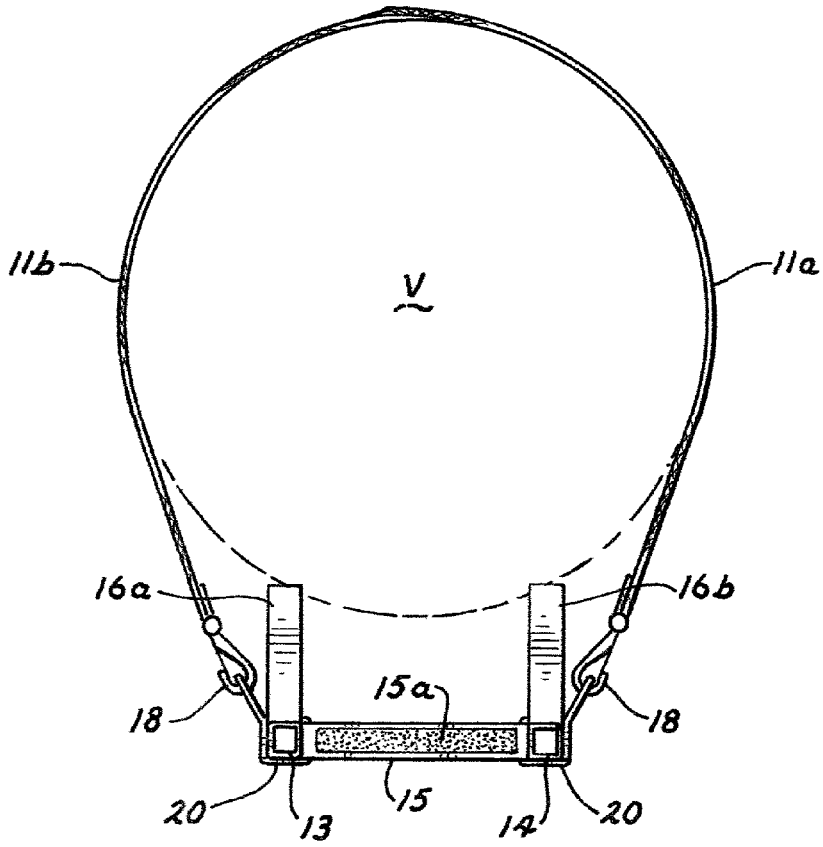
FIG. 3 is a top view of the ladder and climbed element.

Each of the sections 12*a*, 12*b*, 12*c* of ladder 10 is provided with at least one pair of vertical member standoffs 16*a*, 16*b* and although FIG. 3 illustrates these standoffs as being associated with the stiles 13, 14, it should be obvious that, serving as standoffs, they may be associated with the rungs 15 of the ladder 10. The purpose of the standoffs 16*a*, 16*b* is to position the stiles, 13, 14 and rungs 15 a distance from the vertical element to allow the climber to place his or her foot onto a rung 15 and locate the rung 15 at, approximately, the ball or arch of the foot rather than only allowing the users toe to be upon the rung.

As illustrated in FIG. 3, a friction providing member 15*a* may be provided on each of the rungs.

To accommodate the strap system, 11*a*, 11*b*, 11*c*, receiving rings 17 are provided on each of the ladder sections 12*a*, 12*b*, 12*c* and, as illustrated, at least one such ring 17 is provided on each of the stiles 13, 14 to afford at least two such strap receiving rings 17 on each ladder section with, preferably, one such ring being arranged at the upper end of each section.

The ends of the straps 11*a*, 11*b*, 11*c* are provided with either quick connect or permanent hooks 18 to engage the rings 17.

As illustrated in the views, which illustrate a preferred method of attachment, strap 11*a*, is secured to a strap receiving ring 17 on stile 14 of uppermost stile section 12*a*, passes behind the vertical V member and is secured to the lowermost strap receiving ring 17 provided on stile 13 of the lowermost stile section 12*c*. Strap 11*b* similarly is secured to strap receiving ring 17 on stile 13 of uppermost stile section 12*a* passes behind the vertical V member and is secured to the lowermost strap receiving ring 17 provided on stile 14 of the lowermost stile section 12*c*. In this manner, the straps 11*a*, 11*b* cross behind the vertical V member. The straps 11*a*, 11*b* could also be secured about a limb or protrusion of the tree or otherwise attached thereto. Strap tightening devices 11*d*, 11*e* provide for tightening of the straps 11*a*, 11*b* to secure the ladder 10 to the vertical V member.

Additional straps, such as center strap 11*c*, may be provided which will simply encircle the vertical V member and connect with strap receiving rings 17 of the respective stile sections 13, 14. Again, a tightening device 11*f* is provided in such strap 11*c*.

A definite uniqueness of the applicant's invention is the ability of securing the same to the vertical member without requiring any climbing of the ladder.

A further uniqueness of the applicant's ladder 10 is the parallel positioning of the same to the vertical V member being scaled while allowing sufficient room between the vertical V and the ladder 10 for foot placement onto a rung 15. The parallel alignment of support and ladder provides a very important feature when hunting. The hunter, essentially hugs the vertical V, to provide a reduced visibility factor to game and the user does not have to depend upon his balance as is often required when a ladder is leaned against a tree. With applicant's ladder the stability thereof is equal to the stability of the article being scaled. Further, with total foot placement availability, the user will be allowed a higher degree of shiftability than with present ladders.

Figure 4:
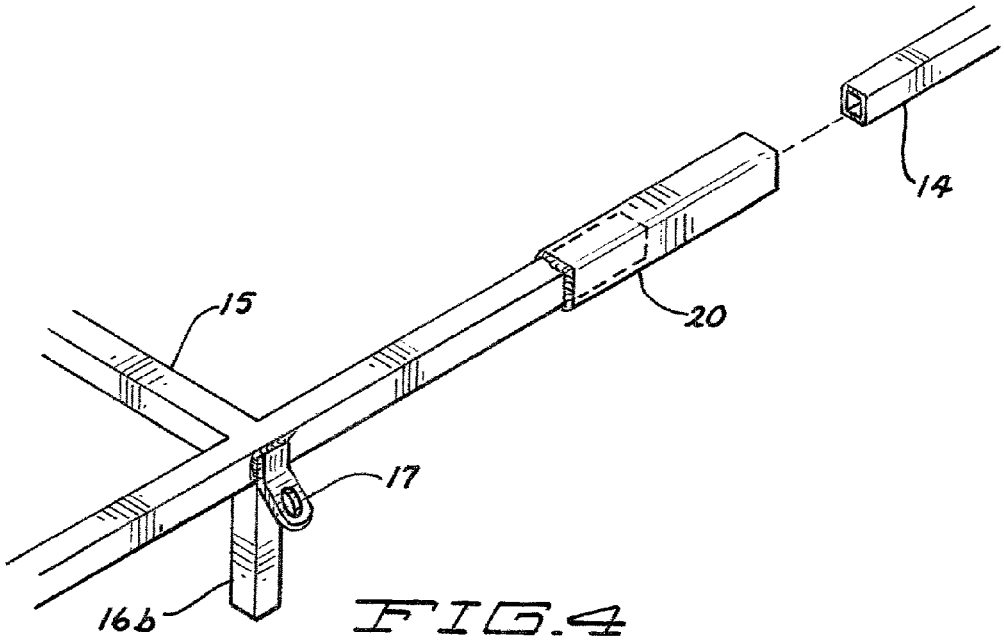
FIG. 4 is a view of one of the connective elements between ladder sections.

For ease of transport and assembly, the ladder 10 is, as stated, provided in sections 12*a*, 12*b*, 12*c* and these sections are joined through a connector 20 which is arranged, preferably, at the uppermost end of each section stile. FIG. 4 illustrates only one such stile 14, a standoff 16*b*, a rung 15, a strap ring 17 and connector 20.

Connector 20 is a tubular member of the same configuration as the stile to over fit and be secured to the end of a stile and receive the next stile therein. In this manner, although only three ladder sections have been illustrated, that the applicant may extend the ladder to any selected or desired height. The length of each section is a matter of choice and will be made with consideration of factors including an easily transported length to enable walking through wooded areas and the weight of the complete section.

It should be obvious that the applicant has provided a ladder for use in scaling of vertical objects such as trees and the like which provides ease of transport and assembly, secure attachment to the vertical member while remaining on the ground and climbing ease and standing ease once the ladder is climbed.

With the elimination of the possibility of the ladder falling from its desired position, the user is at ease to move upon the same and to attach or secure him or herself to the ladder for desired hunting and viewing mobility.

What is claimed is:

1. A ladder for climbing adjacent a generally vertical member comprising:

a first stile and a laterally spaced second stile, both stiles longitudinally extended and serving as side elements, a plurality of laterally extending rungs secured at their ends to the stiles and spaced therealong, to form ladder segments, a standoff on one side of the stiles to abut with the vertical member and position the stiles and rungs a predetermined distance from the vertical member, a connector for connecting adjacent stiles vertically such that the ladder segments are added together to extend the ladder, a ring near a top and bottom of each stile, a strap with a first hook and at a first end of the strap engaging a highest ring of the first stile, the strap adapted to encircle the vertical member, a second hook at a second end of the strap engaging a lowest ring of the second stile such that the strap can secure the ladder to the vertical member, a first hook at a first end of a second strap engaging a highest ring of the second stile, a second strap adapted to encircle the vertical member, a second hook at the second end of the second strap engaging a lowest ring of the first stile such that the strap can secure the ladder to the vertical member, a strap length adjustment means, on a length of the straps near the bottom ring, for adjusting the length of the straps and tightening the straps to secure to the ladder to the vertical member, wherein the straps are connected to the highest rings then the ladder is placed against the vertical member and then to the lowest rings after the ladder is placed against the vertical member and tightened such that a user need not climb the ladder to secure the ladder to the vertical member.

2. A ladder for climbing adjacent a generally vertical member as in claim 1 wherein, a third strap having a first hook and a means for adjusting a length of the third strap and a second hook, to secure the ladder to the vertical member by the first hook engaging a ring on the first stile and a second hook engaging a ring on the second stile at the same height as the first hook, and then tightening the third strap.

3. A method of securing a ladder to a tree or other vertical object comprising, providing a plurality of ladder sections each having a first stile and a second stile with rungs therebetween and stand off means attached thereto, attaching the ladder sections to each other vertically to extend the height of the ladder, attaching a strap having a length adjustment mechanism to a top section of the ladder on each stile, placing the ladder against a vertical object with the stand off means separating the vertical object from the stiles, running the straps from the stiles at the top section of the ladder around the vertical object to the respective opposite stile and attaching the straps to a respective bottom section of the ladder, with the length adjusting mechanism near the bottom section, shortening the length of the straps with the length adjusting mechanism to secure the ladder against the vertical object.

4. A method of securing a ladder to a tree or other vertical object as in claim 3 including the further step of, extending a strap at uniform height from the first stile around the vertical object to the second stile and tightening the strap to secure the ladder to the vertical object.

* * * * *